US008087395B2

(12) United States Patent
Scharp et al.

(10) Patent No.: US 8,087,395 B2
(45) Date of Patent: Jan. 3, 2012

(54) MULTI-PART PISTON FOR AN INTERNAL COMBUSTION ENGINE

(75) Inventors: Rainer Scharp, Vaihingen (DE); Reiner Mueller, Rottweil (DE); Helmut Edel, Rottweil (DE); Bernd Graf, Dietingen (DE); Stefan Kohnle, Fluorn-Winzeln (DE); Dieter Held, Dietingen (DE); Matthias Seifried, Herrenzimmern (DE)

(73) Assignee: MAHLE International GmbH, Stuttgart (DE)

( * ) Notice: Subject to any disclaimer, the term of this patent is extended or adjusted under 35 U.S.C. 154(b) by 408 days.

(21) Appl. No.: 12/381,839

(22) Filed: Mar. 17, 2009

(65) Prior Publication Data

US 2010/0107998 A1 May 6, 2010

(30) Foreign Application Priority Data

Nov. 5, 2008 (DE) ..... 10 2008 055 908

(51) Int. Cl.
*F02F 3/00* (2006.01)
*F02F 3/22* (2006.01)

(52) U.S. Cl. ..... 123/193.6; 123/41.35; 123/219

(58) Field of Classification Search ..... 123/186, 123/216, 219, 222, 231, 255, 256, 193.6, 123/41.35; 29/888.042, 888.044
See application file for complete search history.

(56) References Cited

U.S. PATENT DOCUMENTS

| | | | | |
|---|---|---|---|---|
| 4,506,632 | A * | 3/1985 | Kanda et al. | 123/41.35 |
| 5,052,280 | A * | 10/1991 | Kopf et al. | 92/186 |
| 5,144,923 | A * | 9/1992 | Leites et al. | 123/193.6 |
| 6,026,777 | A * | 2/2000 | Kemnitz et al. | 123/193.6 |
| 6,453,797 | B1 * | 9/2002 | Bauer | 92/186 |
| 2005/0072394 | A1 * | 4/2005 | Gabriel et al. | 123/193.6 |
| 2007/0079775 | A1 * | 4/2007 | Lin et al. | 123/41.35 |

FOREIGN PATENT DOCUMENTS

EP 1 222 364 7/2002

* cited by examiner

*Primary Examiner* — M. McMahon
(74) *Attorney, Agent, or Firm* — Collard & Roe, P.C.

(57) ABSTRACT

A multi-part piston for an internal combustion engine has an upper piston part and a lower piston part. The upper piston part and the lower piston part each have an inner and an outer support element, which elements delimit an outer circumferential cooling channel and an inner cooling chamber, whose cooling chamber bottom has an opening. The opening is closed off with a separate closure element, which has at least one cooling oil opening.

14 Claims, 3 Drawing Sheets

MULTI-PART PISTON FOR AN INTERNAL COMBUSTION ENGINE

CROSS REFERENCE TO RELATED APPLICATIONS

Applicants claim priority under 35 U.S.C. §119 of German Application No. 10 2008 055 908.3 filed Nov. 5, 2008.

BACKGROUND OF THE INVENTION

1. Field of the Invention

The present invention relates to a multi-part piston for an internal combustion engine, having an upper piston part and a lower piston part. The upper piston part and the lower piston part each have an inner and an outer support element, which elements delimit an outer circumferential cooling channel and an inner cooling chamber. The cooling chamber bottom has an opening.

2. The Prior Art

A piston of this type is disclosed in European Patent No. EP 1 222 364 B1. The opening in the cooling chamber bottom allows cooling oil to flow away out of the inner cooling chamber in the direction of the piston crown, in order to lubricate the piston pin. In order to achieve this goal, the opening in the cooling chamber bottom cannot be too large, because then, the cooling oil would no longer flow away in metered manner, and its cooling effect in the inner cooling chamber would at least be reduced. This means that the cooling chamber bottom is configured essentially as a relatively wide and thin circumferential ring land that extends approximately in the radial direction, in the upper region of the lower piston part. However, such a structure is difficult to produce. In the case of a forged lower piston part, in particular, there is the additional problem that the microstructure of the material is changed in the region of the ring land, as the result of forging.

SUMMARY OF THE INVENTION

It is therefore an object of the invention to provide a piston of the stated type, in such a manner that a good cooling effect of the cooling oil in the interior of the cooling chamber and effective lubrication of the piston pin are guaranteed, and, at the same time, the stability of the lower piston part is not impaired.

This object is accomplished according to the invention by a piston for an internal combustion engine, having an upper piston part and a lower piston part, each of the piston parts having an inner and an outer support element, which elements delimit an outer circumferential cooling channel and an inner cooling chamber. The bottom of the cooling chamber has an opening. The opening is closed off with a separate closure element, which has at least one cooling oil opening.

The configuration according to the invention makes it possible to provide a very large opening in the cooling chamber bottom, so that the relatively wide and thin circumferential ring land, which extends approximately in the radial direction, is eliminated. Instead, only a narrow circumferential structure for holding the closure element is required. As a result, the stability of the lower piston part is maintained even if it is a forged part. The at least one cooling oil opening in the closure element provided according to the invention also allows significantly better and more precise metering of the cooling oil that flows away in the direction of the piston pin.

The closure element preferably has two or more cooling openings, so that a very precisely metered amount of cooling oil can flow away out of the inner cooling chamber, in the direction of the piston crown. The closure element can be produced from any desired material. For example, a spring steel sheet metal has proven to be well suited.

The at least one cooling oil opening in the closure element can be configured as a usual round opening, or, for example, also as a slit that extends from the edge of the closure element toward the inside.

A preferred further development provides that the closure element is held, in clamped manner, in at least one engagement groove provided in the region of the opening of the cooling chamber bottom, by means of at least one spring element, and thus is particularly easy to install. For this purpose, the closure element can have a circumferential clamping flange or at least two spring tongues disposed on the outer edge as a spring element. In the latter case, the slits that delimit the spring tongues can serve as cooling oil openings at the same time. In another variant, however, the closure element can also be welded to the cooling chamber bottom of the lower piston part.

The opening in the cooling chamber bottom and the closure element are generally configured to be essentially round. If the opening in the cooling chamber bottom is configured to be oval or an oblong hole, it is practical if the closure element has a shape that corresponds to this. If the closure element is held in a clamped manner, it is sufficient if the closure element has at least two spring elements that lie centered opposite one another.

The upper piston part and/or the lower piston part can be cast parts or forged parts, and can be produced from a steel material, for example, particularly forged. Friction welding, for example, is a possible joining method.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
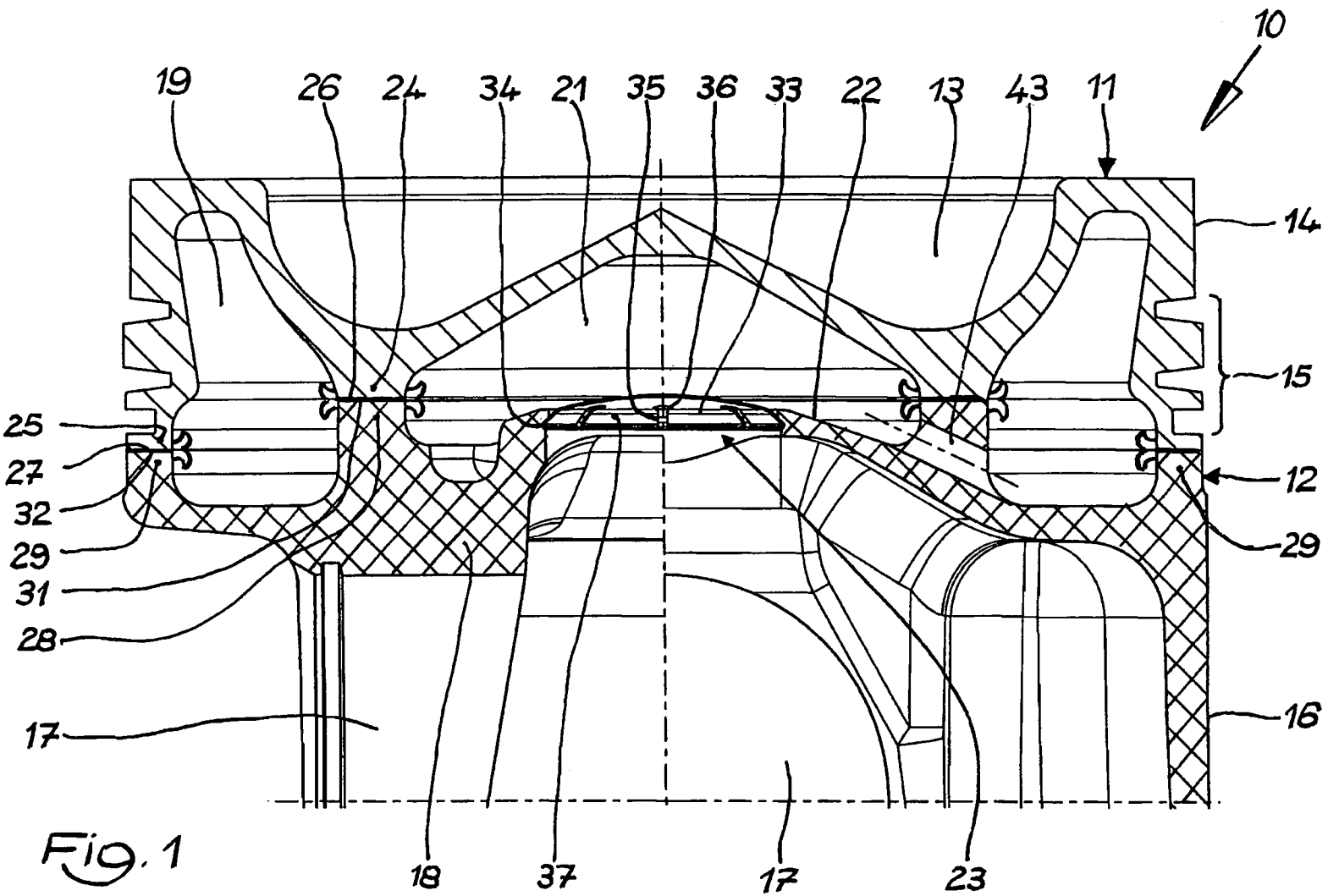
FIG. 1 shows a section through a first exemplary embodiment of a piston according to the invention, whereby the right half of the figure has been rotated by 90° relative to the left half.

Referring now in detail to the drawings, FIG. 1 shows a first exemplary embodiment of a piston 10 according to the invention, which is forged from a steel material in the exemplary embodiment. Piston 10 according to the invention is composed of an upper piston part 11 and a lower piston part 12. Upper piston part 11 has a combustion bowl 13, a circumferential top land 14, and a circumferential ring belt 15. Lower piston part 12 has a piston skirt 16, pin bores 17 for accommodating a piston pin, and pin bosses 18. Upper piston part 11 and the lower piston part 12 form a circumferential outer cooling channel 19 and a central inner cooling chamber 21. Cooling chamber bottom 22 of cooling chamber 21 is provided with a relatively large opening 23.

Upper piston part 11 has an inner support element 24 and an outer support element 25. Inner support element 24 is disposed on the underside of upper piston part 11, circumferentially, in ring shape, and has a joining surface 26. Inner support element 24 furthermore forms part of the circumferential wall of inner cooling chamber 21. Outer support element 25 of upper piston part 11 is formed below ring belt 15, in the exemplary embodiment, and has a joining surface 27.

Lower piston part 12 also has an inner support element 28 and an outer support element 29. Inner support element 28 is disposed on the top of lower piston part 12, circumferentially, and has a joining surface 31. Inner support element 28 furthermore forms part of the circumferential wall of the inner cooling chamber 21. Outer support element 29 is formed as an extension of piston skirt 16 in the exemplary embodiment, and has a joining surface 32. A cooling oil channel 43 is provided in the inner support element 28, and connects cooling channel 19 with cooling chamber 21. Cooling oil channel 43 runs at an angle upward, proceeding from cooling channel 19, in the direction of cooling chamber 21.

Upper piston part 11 and lower piston part 12 were joined, in the embodiment shown, in known manner, by friction welding along joining surfaces 26, 31 and 27, 32, respectively.

Opening 23 in cooling chamber bottom 22 is closed off with a closure element 33. In the exemplary embodiment, closure element 33 is produced from a spring sheet metal, approximately 0.8 mm thick, and held in opening 23 in a clamped manner. For this purpose, a circumferential engagement groove 34 is provided in cooling chamber bottom 22 in the inner region of opening 23. Closure element 33 is provided with slits 35 that extend radially inward, along its edge region, which slits open into a rounded part 36. Slits 35 and rounded parts 36 serve as cooling oil openings that allow the cooling oil to flow away out of inner cooling chamber 21 in the direction of the piston pin during operation. Slits 35 and rounded parts 36 are punched out of closure element 33 in the embodiment shown.

The regions delimited by the slits 35 simultaneously represent spring tongues 37 by means of which closure element 33 is held in engagement groove 34, in a clamped manner. For assembly, closure element 33 is pressed into opening 23 of cooling chamber bottom 22, coming from the direction of pin bores 17. In this connection, spring tongues 37 at first give way, and then engage into engagement groove 34.

Figure 2:
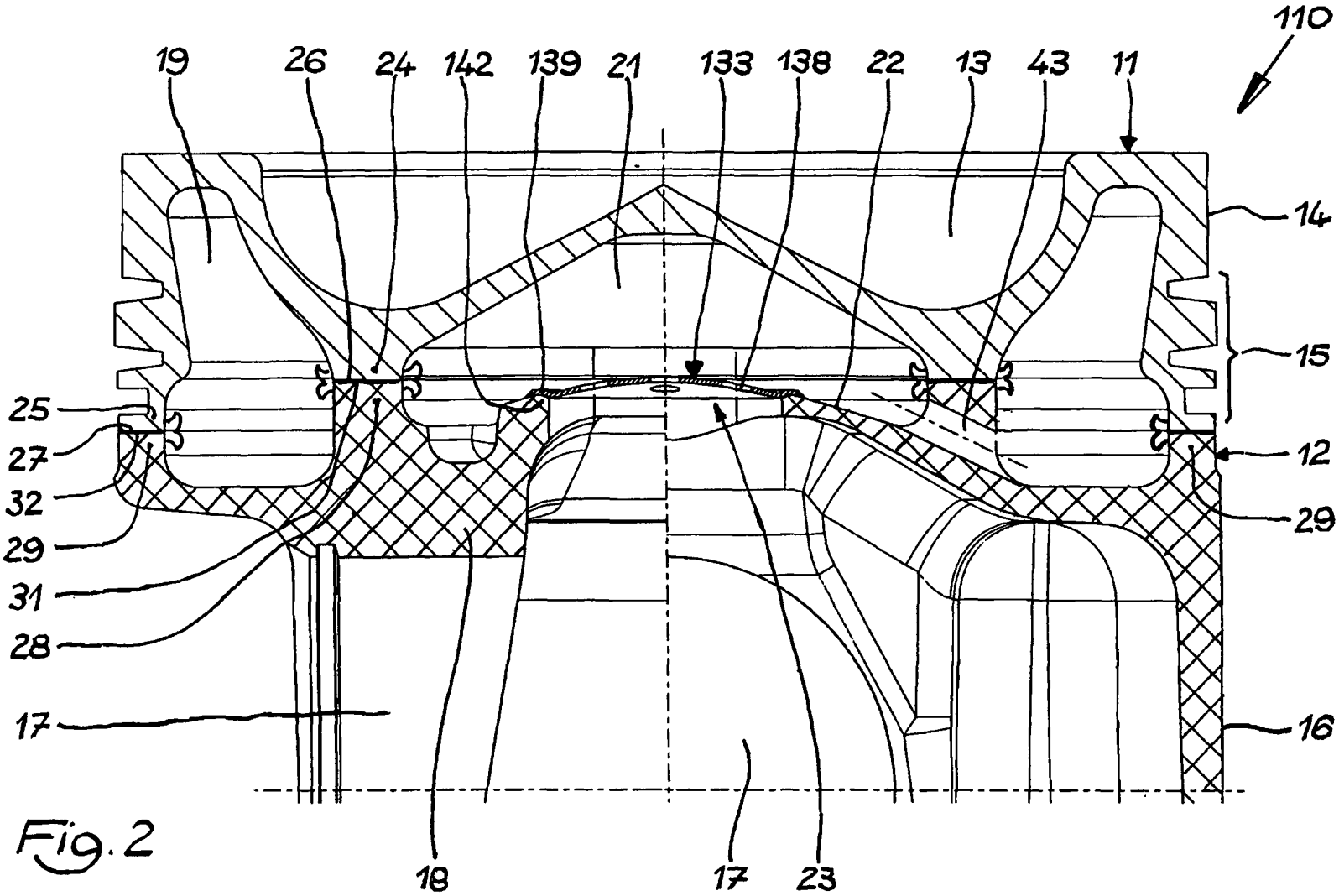
FIG. 2 shows a section through another exemplary embodiment of a piston according to the invention, whereby the right half of the figure has been rotated by 90° relative to the left half.

FIG. 2 shows another exemplary embodiment of a piston 110 according to the invention. Piston 110 has essentially the same construction as piston 10 according to FIG. 1, so that the same structures are provided with the same reference symbols, and with regard to these reference symbols, reference is made to the description of FIG. 1.

A significant difference from the piston 10 according to FIG. 1 consists in the fact that cooling chamber bottom 22 does not have an engagement groove in the inner region of opening 23. Furthermore, closure element 133 that closes off opening 23 is provided, in usual manner, round openings 138 for passage of the cooling oil out of cooling chamber 21 in the direction of the piston pin. Closure element 133 consists, in the exemplary embodiment, of a metallic material, and is welded to cooling chamber bottom 22 in the region of opening 23. For this purpose, closure element 123 has a welding flange 139. In the region of opening 23, cooling chamber bottom 22 is provided with a corresponding contact edge 142 for welding flange 139, which edge runs around opening 23.

Figure 3:
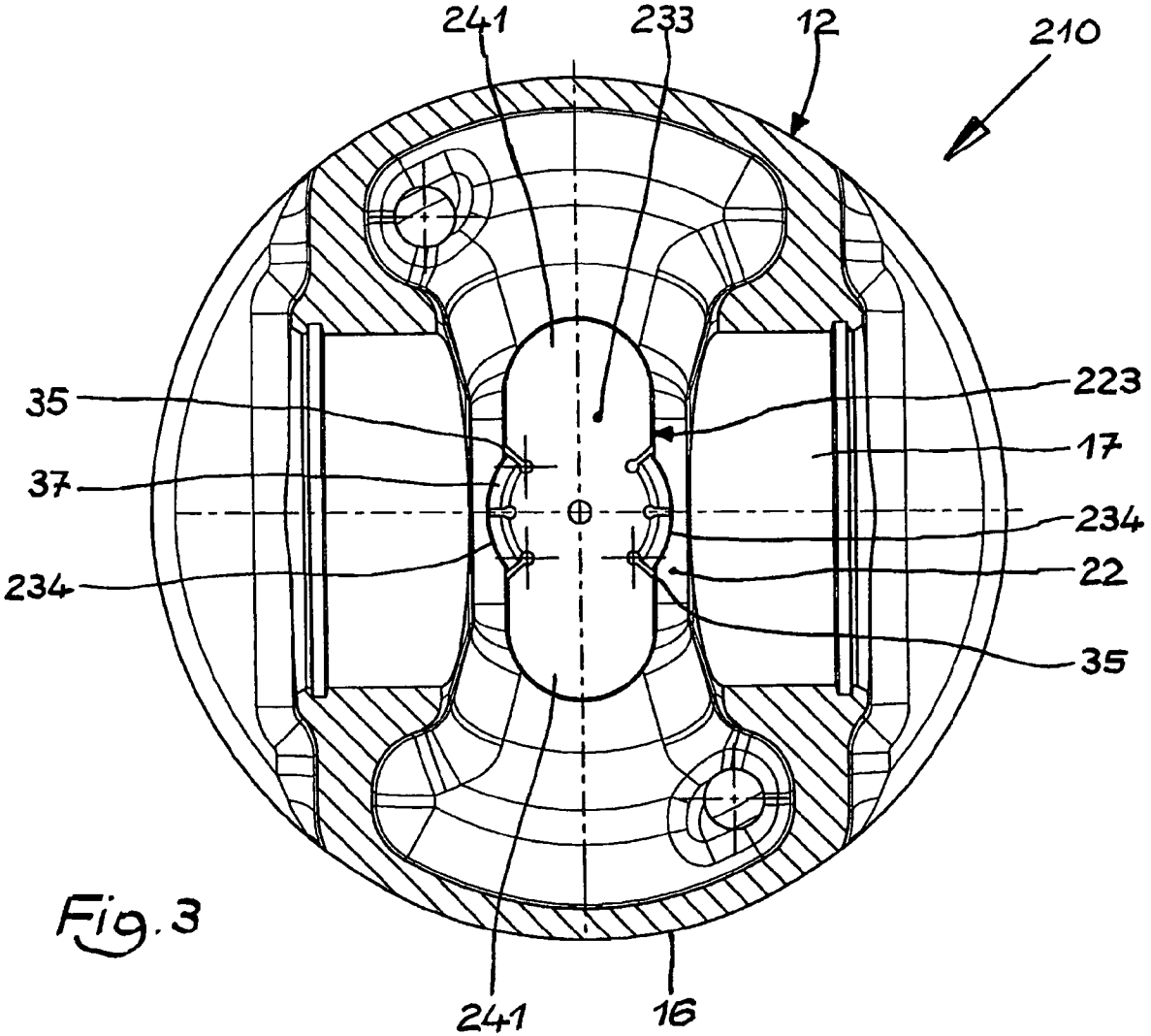
FIG. 3 shows a top view of a lower piston part for another exemplary embodiment of a piston according to the invention.

FIG. 3 shows a top view of a lower piston part 12 for another exemplary embodiment of a piston 210 according to the invention. Piston 210, i.e. lower piston part 12, has essentially the same construction as piston 10 according to FIG. 1, so that the same structures are provided with the same reference symbols, and with regard to these reference symbols, reference is made to the description of FIG. 1.

A significant difference from the piston 10 according to FIG. 1 consists in the fact that cooling chamber bottom 22 in lower piston part 12 has an opening 223 in the approximate shape of an oblong hole opening 223 is closed off with a closure element 233 that is configured to essentially correspond to opening 223, in order to be able to close this off completely.

In the exemplary embodiment, closure element 233 is also produced from a spring sheet metal, and held in opening 223 in a clamped manner. For this purpose, two engagement grooves 234 disposed in a centered manner and lying opposite one another are provided in cooling chamber bottom 22, in the interior region of opening 223. In the exemplary embodiment, closure element 233 is provided with slits 35 that are disposed centered, lying opposite one another, extending radially inward, which open into a rounded part 36. In the exemplary embodiment, three slits 35 lie opposite one another. Slits 35 and rounded part 36 serve as cooling oil openings that allow the cooling oil to flow away out of inner cooling chamber 21 in the direction of the piston pin during operation. Slits 35 and rounded parts 36 are punched out of closure element 233 in the exemplary embodiment.

The regions delimited by slits 35 simultaneously represent spring tongues 37 by means of which closure element 233 is held in the engagement grooves 234, in a clamped manner. For assembly, closure element 233 is pressed into opening 223 of cooling chamber bottom 22, coming from the direction of pin bores 17. In this connection, spring tongues 37 at first give way, and then engage into engagement grooves 234. Regions 241 of closure element 233 that follow the clamping region make contact below opening 223 of cooling chamber bottom 22.

In this representation, in particular, it can easily be seen that the broad, radially circumferential ring lands required in the state of the art have been eliminated.

Accordingly, while only a few embodiments of the present invention have been shown and described, it is obvious that many changes and modifications may be made thereunto without departing from the spirit and scope of the invention.

What is claimed is:

1. A multi-part piston for an internal combustion engine, comprising;

an upper piston part having an inner support element and an outer support element;

a lower piston part having an inner support element and an outer support element, which elements delimit an outer circumferential cooling channel and an inner cooling chamber, wherein a bottom of the cooling chamber has an opening that is closed off with a separate closure element, said closure element having at least one cooling oil opening configured as a slit that extends inward from an edge of the closure element.

2. The piston according to claim 1, wherein the closure element has two or more cooling oil openings.

3. The piston according to claim 1, wherein the closure element is produced from a steel spring sheet metal.

4. The piston according to claim 1, wherein the closure element is clamped in at least one engagement groove provided in a region of the opening of the cooling chamber bottom, by at least one spring element.

5. The piston according to claim 4, wherein the spring element is a circumferential clamping flange on the closure element.

6. The piston according to claim 4, wherein the spring element comprises at least two spring tongues disposed on an outer edge of the closure element.

7. The piston according to claim 1, wherein the closure element is welded to the cooling chamber bottom of the lower piston part.

8. The piston according to claim 1, wherein the opening in the cooling chamber bottom and the closure element are configured to be essentially round.

9. The piston according to claim 1, wherein the opening in the cooling chamber bottom is configured to be oval or as an oblong hole, and the closure element is configured to correspond to a shape of the opening.

10. The piston according to claim 9, wherein the closure element has at least two spring elements that lie centered opposite one another.

11. The piston according to claim 1, wherein at least one of the upper piston part and the lower piston part are forged parts.

12. The piston according to claim 1, wherein at least one of the upper piston part and the lower piston part are produced from a steel material.

13. The piston according to claim 1, wherein the upper piston part and the lower piston part are connected with one another by means of friction welding.

14. A multi-part piston for an internal combustion engine, comprising;

an upper piston part having an inner support element and an outer support element;

a lower piston part having an inner support element and an outer support element, which elements delimit an outer circumferential cooling channel and an inner cooling chamber, wherein a bottom of the cooling chamber has an opening that is closed off with a separate closure element, said closure element having at least one cooling oil opening, and wherein the closure element is clamped in at least one engagement groove provided in a region of the opening of the cooling chamber bottom, by at least one spring element comprising at least two spring tongues disposed on an outer edge of the closure element.

* * * * *